United States Patent [19]

Flanagan

[11] 4,174,304

[45] * Nov. 13, 1979

[54] SURFACTANT SYSTEM

[75] Inventor: John J. Flanagan, Chicago, Ill.

[73] Assignee: Bullen Chemical Company Midwest, Inc., Chicago, Ill.

[ * ] Notice: The portion of the term of this patent subsequent to Dec. 27, 1994, has been disclaimed.

[21] Appl. No.: 862,595

[22] Filed: Dec. 20, 1977

Related U.S. Application Data

[63] Continuation-in-part of Ser. No. 832,364, Sep. 12, 1977, abandoned, and a continuation-in-part of Ser. No. 601,054, Aug. 1, 1975, Pat. No. 4,065,409.

[51] Int. Cl.[2] ..... C11D 1/62; C11D 1/75; C11D 1/825; C11D 1/835

[52] U.S. Cl. ..... 252/524; 134/38; 134/40; 252/153; 252/156; 252/158; 252/173; 252/523; 252/527; 252/528; 252/541; 252/542; 252/546; 252/547; 252/DIG. 1; 252/DIG. 14; 252/174.14; 252/174.21; 252/174.22

[58] Field of Search ..... 252/89, 106, 153, 173, 252/156, 158, 528, 547, DIG. 1, DIG. 14, 524, 527, 523, 541, 542, 546; 134/38, 40

[56] References Cited

U.S. PATENT DOCUMENTS

| | | | |
|---|---|---|---|
| 3,296,145 | 1/1967 | Findlan | 252/106 |
| 3,351,557 | 11/1967 | Almstead | 252/106 |
| 3,537,993 | 11/1970 | Coward | 252/547 X |
| 3,553,143 | 1/1971 | Bauer | 252/156 X |
| 3,679,609 | 7/1972 | Castner | 252/527 |
| 3,812,046 | 5/1974 | Lancz | 252/106 |
| 3,843,563 | 10/1974 | Davies | 252/547 |
| 3,850,818 | 11/1974 | Katsumi | 252/547 X |
| 3,869,399 | 3/1975 | Collins | 252/118 |
| 3,936,537 | 2/1976 | Baskerville | 252/547 X |
| 3,954,648 | 5/1976 | Belcak | 252/158 |
| 3,965,048 | 6/1976 | Murtaugh | 252/527 |
| 4,038,196 | 7/1977 | Minegish | 252/547 X |
| 4,065,409 | 12/1977 | Flanagan | 252/528 |

*Primary Examiner*—Dennis L. Albrecht
*Attorney, Agent, or Firm*—Kegan, Kegan & Berkman

[57] ABSTRACT

An improved surfactant system comprising a mixture of a non-ionic detergent, a tertiary amine oxide, and a quaternary ammonium halide. The surfactant system of the invention is combined with other ingredients to yield 14 different commercially useful cleaners. Each of these cleaners has improved detergent properties compared with prior art cleaners because of a high proportion of quaternary ammonium halide in the concentrated surfactant system used as a principal ingredient therein.

9 Claims, No Drawings

SURFACTANT SYSTEM

This application is a continuation-in-part of copending U.S. patent application Ser. No. 601,054 filed Aug. 1, 1975 entitled HARD SURFACE DETERGENT COMPOSITION (now U.S. Pat. No. 4,065,409 issued Dec. 27, 1977); and of abandoned U.S. patent application Ser. No. 832,364 filed Sept. 12, 1977 entitled SURFACTANT SYSTEM.

BACKGROUND OF THE INVENTION

Various types of surfactant systems are known in the prior art, some of which include non-ionic detergents and tertiary amine oxides. Occasionally, small proportions of a quaternary ammonium compound may be incorporated therein as a fabric softener or as an optional germicide. The present invention relates to an improved surfactant system including at least 8-50% by weight and preferably about 10-13% by weight, of a quaternary ammonium halide. Cleaning compositions incorporating the surfactant system of the invention have improved detergent properties compared with compositions containing only a non-ionic detergent combined with a quaternary ammonium halide, a tertiary amine oxide combined with a quaternary ammonium halide, or an insufficient proportion of quaternary ammonium halide combined with a mixture of non-ionic detergent and tertiary amine oxide.

It is a principal object of the present invention to provide a surfactant system having improved detergent properties compared with prior art surfactant systems.

It is a related object of the invention to provide a surfactant system concentrate that is combined with other ingredients and diluted with water to form at least 14 distinct cleaning preparations.

Another object of the invention is to provide a hard surface cleaning composition that exhibits improved detergent properties compared with prior art compositions.

Additional objects and advantages of the surfactant system of the invention will become apparent to persons skilled in the art from the following specification.

DETAILED DESCRIPTION OF A PREFERRED EMBODIMENT

The present invention relates to a surfactant system comprising an aqueous solution of a non-ionic detergent having a polyoxyethylene chain in its molecule; a tertiary amine oxide; and a quaternary ammonium halide. A viscosity reducing agent is also included to provide room temperature viscosity consistent with ease of handling during use. Although the non-ionic detergent, the tertiary amine oxide, and the quarternary ammonium halide used in this invention are each known to have detergent or surface-active properties, the invention is based upon the unexpected discovery that when the tertiary amine oxide and non-ionic detergent are combined with a sufficiently high proportion of a quaternary ammonium halide, these ingredients provide a detergent effect which is much greater than is achieved through the use of only one or two of these materials at equivalent concentrations. Although the reason for this result is not known, it appears that the quaternary ammonium halide has a potentiating or synergistic effect when it is combined in a sufficiently high proportion with the other two ingredients.

The non-ionic detergent used in this invention belongs to a class of compounds formed by condensation of an alkyl phenol, an alkyl amine, or an aliphatic alcohol with sufficient ethylene oxide to produce a compound having a polyoxyethylene chain within the molecule, i.e., a chain composed of recurring (—O—$CH_2$—$CH_2$—) groups. Many compounds of this type are known and used for their detergent, surface active, wetting and emulsifying properties. The detergents of this type which are useful in the present invention are those produced by condensation of about 4-16, and perferably 4-12 moles of ethylene oxide with one mole of a compound selected from the group consisting of (1) an alkyl phenol having about 1-15, and preferably 7-10, carbon atoms in the alkyl group; (2) an alkyl amine having about 10-20, and preferably 12-16, carbon atoms in the alkyl group; (3) an aliphatic alcohol having about 10-20, and preferably 12-16, carbon atoms in its molecule; and (4) a hydrophobic base formed by condensing propylene oxide with propylene glycol. Mixtures of two or more of the non-ionic detergent groups identified above may also be used. The number of moles of ethylene oxide which are condensed with one mole of parent compound (i.e. the alkyl phenol, the alkyl amine, or the aliphatic alcohol) depends upon the molecular weight of the hydrophobic portion of the condensation product. The non-ionic detergent used in the invention should have sufficient ethylene oxide units to insure solubility thereof in the detergent composition or in any dilution thereof which may be used in practice. In general, non-ionic detergents suitable for use in the invention can be formed by condensing the reactants in the proportions set forth above.

The alkyl phenols which can be condensed with ethylene oxide to give a non-ionic detergent useful in the invention are those in which the alkyl group contains about 1-15, and preferably about 7-10, carbon atoms in a straight or branched chain, which can be saturated or unsaturated. In a particularly preferred embodiment the nonionic detergent is a mixture of detergents produced by condensation of 75% of 8-12 moles of ethylene oxide with 1 mole of nonyl phenol and 25% of 4-5 moles of ethylene oxide with 1 mole of nonyl phenol. Examples of other suitable alkyl phenol-ethylene oxide condensation products are those in which the hydrophobic portion of the product is formed from phenol, methyl phenol(cresol), ethyl phenol, hexyl phenol, octyl phenol, decylphenyl, dodecylphenol, and the like.

Other nonionic detergents which can be used in the invention are those wherein an alkyl amine or aliphatic alcohol, in which the alkyl group in each case has about 10-20, and preferably about 12-16, carbon atoms in a straight or branched chain which can be saturated or unsaturated, is condensed with about 8-16, and preferably about 9-13 moles of ethylene oxide. Examples of such compounds are the condensation products of ethylene oxide with decylamine, dodecylamine, tridecylamine, hexadecylamine, oxtadecylamine, and the like; and with decyl alcohol, dodecyl alcohol, tridecyl alcohol, hexadecyl alcohol, octadecyl alcohol and the like.

The second ingredient in the synergistic combination of surface active agents used in the invention is a tertiary amine oxide selected from the following group:

(1) Alkyl di(lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples of such tertiary amine oxides useful in the invention include lauryl dimethyl amine oxide, myristyl dimethyl amine oxide, and those in which the alkyl group is a mixture of different chain lengths, such as lauryl/myristyl dimethyl amine oxide, dimethyl cocoamine oxide, dimethyl (hydrogenated tallow) amine oxide, and myristyl/palmityl dimethyl amine oxide.

(2) Alkyl di(hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide; bis(2-hydroxy-ethyl) tallowamine oxide; and bis(2-hydroxyethyl) stearylamine oxide.

(3) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide.

(4) Alkyl morpholine oxides in which the alkyl group has about 10–20, and preferably 12–16 carbon atoms, and can be straight or branched chain, saturated or unsaturated.

Mixtures of any two or more of the amine oxide detergents identified above may also be used.

The third ingredient in the synergistic combination of surface active agents used in the invention is a quaternary ammonium halide surfactant having the formula

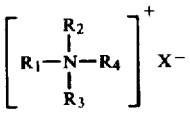

Quaternary ammonium halide surfactants useful in the invention are selected from the group consisting of:

(1) Compounds wherein $R_1$ and $R_2$ are lower (i.e., $C_1$–$C_7$) alkyl, and preferably methyl groups; $R_3$ is a phenyl group or a phenyl group substituted with an alkyl group having about 1–18 carbon atoms or an alkyl group having about 8–20, and preferably 8–18, carbon atoms; $R_4$ is a phenyl group or a phenyl group substituted with an alkyl group having about 1–18 carbon atoms or an alkyl group having about 8–20, and preferably 8–18, carbon atoms; and X is a halogen, preferably chlorine. Examples of suitable quaternary ammonium halide surfactants include dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{14}$) n-alkyl dimethyl ethylbenzyl ammonium chloride, and dimethyl (difatty) ammonium chloride. In a particularly preferred embodiment of the invention the quaternary ammonium halide surfactant used is a mixture of about (34% by weight $C_{12}$ and 16% by weight $C_{14}$) n-alkyl dimethyl ethylbenzyl ammonium chloride, and about (30% by weight $C_{14}$, 15% by weight $C_{16}$, 2½% by weight $C_{12}$ and 2½% by weight $C_{18}$) n-alkyl dimethyl benzyl ammonium chloride.

(2) Compounds wherein $R_1$, $R_2$ and $R_3$ are lower (i.e. $C_1$–$C_7$) alkyl, and preferably methyl groups; $R_4$ is an alkyl or phenyl-substituted alkyl group having about 8–20, and preferably 8–18 carbon atoms; and X is a halogen, preferably chlorine.

(3) "Ethoquad" compounds wherein $R_1$ is an alkyl or phenyl-substituted alkyl group having about 10–20, and preferably 12–16 carbon atoms; $R_2$ is lower(i.e. $C_1$–$C_7$) alkyl and preferably a methyl group; $R_3$ is $[—CH_2CH_2O—]_xH$ and $R_4$ is $[—CH_2CH_2O—]_yH$, with the sum of x + y varying between about 2 and 50. Examples of suitable compounds are those sold by Armak under the trade names Ethoquad 18/12; Ethoquad C/25; and Ethoquad O/25.

In the surfactant system concentrate of the invention, the nonionic detergent is present in a concentration of about 25–75% and preferably 40–50% by weight; the amine oxide is present in a concentration of about 5–65% and preferably 5–10% by weight; the quaternary ammonium halide is present in a concentration of about 8–50% and preferably 8–15% by weight; and the remainder is water. Because of the relatively high concentrations of the active ingredients it is necessary to incorporate about 1–6% by weight of a viscosity reducing agent, preferably isopropanol. A particularly preferred surfactant system concentrate of the invention is described below as Example I.

EXAMPLE I

SURFACTANT SYSTEM CONCENTRATE

| INGREDIENT | % BY WT. |
|---|---|
| Nonionic detergent - condensation product of 9–10 moles of ethylene oxide with 1 mole of nonyl phenol | 44.2 |
| Tertiary amine oxide-lauryl dimethyl amine oxide | 7.2 |
| Quaternary ammonium halide - mixture of about (34% by weight $C_{12}$ and 16% by weight $C_{14}$) n-alkyl dimethyl ethylbenzyl ammonium chloride, and about (30% by weight $C_{14}$, 15% by weight $C_{16}$, 2½% by weight $C_{12}$ and 2½% by weight $C_{18}$) n-alkyl dimethyl benzyl ammonium chloride. | 10.2 |
| Quaternary mixture stabilizer - ethanol | 2.6 |
| Emulsion stabilizer - isopropanol | 2.9 |
| Water | 32.9 |

The surfactant system of Example I is combined with other ingredients and diluted with water to form the 14 different products identified below as Examples II through XV. It is a principal advantage of the surfactant system of the invention that these 14 products can be formulated close to the point of actual use from only one surfactant system rather than from three separate detergent ingredients. It is a related advantage that these 14 end products need not be shipped from the manufacturer to the actual user. Shipping costs are reduced by formulating the end products in greater proximity to the end user than with traditional distribution systems relying upon shipment of fully diluted end products.

Incorporated in the compositions of Examples II through V, VII through XI, XIII and XV are conventional builders commonly used in conjunction with synthetic detergents which function to improve the detergent properties of the compositions. The builders are typically alkaline salts such as the alkali metal carbonates, phosphates, and silicates. In addition to improving the detersive properties of the compositions. Such builders control and maintain the pH of the bath, modify the adsorption of the detergent on the substrate and/or the soil and act as suspending or peptizing agents. Examples of suitable builders for use in the invention include sodium tripolyphosphate, tetra sodium pyrophosphate, trisodium phosphate, sodium carbonate, sodium orthosilicate, sodium metasilicate and the corresponding potassium salts. Alkali metal hydroxides such as sodium hydroxide and potassium hydroxide are used as builders when a higher pH is desired. Sodium hydroxide is added to the detergent compositions of Examples IV, V, VI, XII and XIII.

The three principal ingredients used in the surfactant system of Example I, being surface active agents, have a tendency to generate copious quantities of foam. The presence of foam is not necessary for production of a detergent effect and in many applications, including the mechanical or handmopping of a floor, foam is undesirable. Accordingly, the cleaning compositions of Examples II through VII include small quantities of an anti-foam in a concentration sufficient to prevent foaming. Typically, small concentrations on the order of 0.001–0.01% by weight of an anti-foam agent can be used. The anti-foam agent can be any conventional type, including those based on silicones(e.g., methyl polysiloxanes) or other water-insoluble oils of low volatility and strong spreading power. Other anti-foam agents which can be used include glyceride oils, fatty acids, and higher alcohols and glycols.

In the cleaning compositions of Examples III, IV, X, XI, XIII and XV tetrasodium ethylene diamine tetraacetate (tetrasodium E.D.T.A.) is included as a water softening agent. Tetrasodium E.D.T.A. has the advantage of retaining its water softening power at higher temperatures than other traditional water softeners, thereby being suitable for high temperature applications such as in locations where steam is generated.

The following is a preferred composition of a degreasing cleaner for hard surface applications made in accordance with the present invention:

EXAMPLE II

DEGREASING CLEANER

| INGREDIENT | GALS. | WEIGHT (lb.) | % BY WEIGHT |
|---|---|---|---|
| Surfactant system concentrate (Example I) | .036 | 0.3 | 3.4 |
| Sodium Carbonate | | 0.15 | 1.7 |
| Sodium Metasilicate - Anhydrous | | 0.225 | 2.6 |
| Tetrasodium Pyrophosphate - technical grade | | 0.113 | 1.3 |
| Water | .964 | 8.0 | 91.0 |
| Defoamer | | 0.33 gm | .009 |
| Dye to suit | | 0.12 gm | |

The composition of Example II is homogeneous and stable against phase separation. It can be diluted with up to 100 or more parts of water to provide detergent solutions useful for a wide variety of hard surface cleaning applications.

The composition of Example II was tested by diluting it with water in the ratio of about 20 parts of water to 1 part of detergent concentrate. About 4 ounces of the diluted solution was placed into a beaker and about 2 cc. each of a vegetable oil and a used automobile crank case oil were added. On stirring by hand, the vegetable and mineral oils were emulsified immediately.

For comparison, the above test was repeated using a detergent solution prepared from a commercially available hard surface detergent in which the detergent is partly composed of ethylene glycol monobutyl ether (butyl Cellosolve). When diluted to give a detergent solution containing an equal concentration of active ingredients, the commercial solution was unable to emulsify the added vegetable and mineral oils.

For a second test, there was employed a test procedure recommended by the Chemical Specialties Manufacturers Association (Tentative Method, revised 3/15/74, "Evaluating the Relative Efficiency of Aqueous Cleaners on Painted Surfaces"). In the test, glass panels coated with a standard white paint are marked by means of standard test pencils and crayons which are applied under controlled increasing pressure to the painted surface to form a series of lines. The detergent to be tested is evaluated for its ability to remove or reduce the intensity of the lines on the glass panels using a Gardner Straightline Washability Apparatus. The effectiveness of a test detergent solution is evaluated against the performance of a standard solution having the following composition:

| | |
|---|---|
| Sodium carbonate | 0.5% by weight |
| Sodium tripolyphosphate | 0.2% |
| Ethylene glycol monobutyl ether | 5.0% |
| Nonionic detergent (condensation product of 1 mole of octylphenyl with about 10 moles of ethylene oxide) | 0.5% |
| Water | 93.8% |
| | 100.0% |

The detergent concentrate of Example II, diluted to a water content of 93.8% to match the standard solution, was evaluated against the standard. For use, each concentrate was diluted with water in the ratio of 20 parts water per 1 part of concentrate. The results showed that the solution of the invention was more effective in removing or lightening the applied markings. The concentrate of Example II achieved a rating of 7 (total removal) for the crayon markings, and a rating of 6 (faint trace of soil remaining) for the pencil markings. By contrast, the standard solution had a rating of 2 (slight decrease in soil) for the crayon markings and a rating of 4 (50% of soil remaining) for the pencil markings.

The following Examples III through XIV are other cleaning compositions that are formulated from the concentrated surfactant system of Example I:

EXAMPLE III

NON-PHOSPHATE DEGREASER, EMULSIFIER AND CLEANER

| INGREDIENT | GALS. | WEIGHT (lb.) | % BY WEIGHT |
|---|---|---|---|
| Surfactant System Concentrate (Example I) | .036 | 0.3 | 3.5 |
| Sodium Metasilicate - Anhydrous | | 0.222 | 2.6 |
| Tetrasodium E.D.T.A. | | 0.72 | 0.8 |
| Defoamer | | 0.33 gm | 0.009 |
| Dye to suit | | 0.12 gm | |
| Water | .964 | 7.98 | 93.1 |

EXAMPLE IV

STEAM OR PRESSURE WASHING DEGREASING DETERGENT

| INGREDIENT | GALS. | WEIGHT (lb.) | % BY WEIGHT |
|---|---|---|---|
| Surfactant System Concentrate (Example I) | .036 | 0.3 | 3.4 |
| Sodium Metasilicate - Anhydrous | | 0.222 | 2.5 |
| Tetrasodium Pyrophosphate - Technical grade | | 0.099 | 1.1 |
| Sodium Hydroxide | | 0.195 | 2.2 |
| Tetrasodium E.D.T.A. | | 0.069 | 0.8 |
| Defoamer | | 0.33 gm | 0.008 |
| Dye to suit | | | |

EXAMPLE IV-continued

STEAM OR PRESSURE WASHING DEGREASING DETERGENT

| INGREDIENT | GALS. | WEIGHT (lb.) | % BY WEIGHT |
|---|---|---|---|
| Water | .964 | 7.88 | 90.0 |

EXAMPLE V

HIGH PRESSURE SPRAY CLEANER AND HEAVY DUTY DEGREASER

| INGREDIENT | GALS. | WEIGHT (lb.) | % BY WEIGHT |
|---|---|---|---|
| Surfactant System Concentrate (Example I) | .036 | 0.3 | 3.4 |
| Sodium Metasilicate | | 0.22 | 2.5 |
| Tetrasodium Pyrophosphate | | 0.098 | 1.1 |
| Sodium Hydroxide | | 0.24 | 2.7 |
| Defoamer | | 0.33 gm | |
| Dye to suit | | | |
| Water | .964 | 8.03 | 90.3 |

EXAMPLE VI

HIGH STRENGTH STEAM CLEANER

| INGREDIENT | GALS. | WEIGHT (lb.) | % BY WEIGHT |
|---|---|---|---|
| Surfactant System Concentrate (Example I) | .036 | .30 | 3.4 |
| Sodium Hydroxide | | .43 | 4.9 |
| Sodium Gluconate | | .075 | 0.8 |
| Defoamer | | 0.33 gm | |
| Dye to suit | | | |
| Water | .964 | 7.9 | 90.8 |

EXAMPLE VII

AMMONIATED FLOOR STRIPPER AND DEGREASER

| INGREDIENT | GALS. | WEIGHT (lb.) | % BY WEIGHT |
|---|---|---|---|
| Surfactant System Concentrate (Example I) | .036 | 0.3 | 3.4 |
| Sodium Carbonate | | .15 | 1.7 |
| Sodium Metasilicate | | .225 | 2.6 |
| Tetrasodium Pyrophosphate | | .113 | 1.3 |
| Ammonia | | .053 | 0.6 |
| Defoamer | | 0.33 gm | 0.008 |
| Water | .964 | 7.95 | 90.4 |

EXAMPLE VIII

HEAVY DUTY DEGREASING CLEANER

| INGREDIENT | GALS. | WEIGHT (lb.) | % BY WEIGHT |
|---|---|---|---|
| Surfactant System Concentrate (Example I) | .0384 | .325 | 3.7 |
| Sodium Carbonate | | .15 | 1.7 |
| Sodium Metasilicate | | .23 | 2.6 |
| Tetrasodium Pyrophosphate | | .115 | 1.3 |
| Dye to Suit | | | |
| Water | .9616 | 8.01 | 90.7 |

EXAMPLE IX

CLEANER

| INGREDIENT | GALS. | WEIGHT (lb.) | % BY WEIGHT |
|---|---|---|---|
| Surfactant System Concentrate (Example I) | .0384 | .325 | 3.7 |
| Sodium Tripolyphosphate | | .346 | 4.0 |
| Dye to suit | | | |
| Water | .9616 | 8.01 | 92.2 |

EXAMPLE X

HEAVY DUTY NON-PHOSPHATE INDUSTRIAL CLEANER

| INGREDIENT | GALS. | WEIGHT (lb.) | % BY WEIGHT |
|---|---|---|---|
| Surfactant System Concentrate (Example I) | .038 | .325 | 3.8 |
| Sodium Metasilicate - Anhydrous | | .222 | 2.6 |
| Tetrasodium E.D.T.A. | | .07 | 0.8 |
| Dye to suit | | | |
| Water | .962 | 7.95 | 92.8 |

EXAMPLE XI

NON-PHOSPHATE CLEANER

| INGREDIENT | GALS. | WEIGHT (lb.) | % BY WEIGHT |
|---|---|---|---|
| Surfactant System Concentrate (Example I) | .038 | .3 | 3.5 |
| Sodium Carbonate | | .15 | 1.8 |
| Sodium Metasilicate (anhydrous) | | .045 | 0.5 |
| Borax(5 mole Sodium Borate) | | .052 | 0.6 |
| Tetrasodium E.D.T.A. | | .06 | 0.7 |
| Dye to suit | | | |
| Water | .962 | 7.9 | 92.9 |

EXAMPLE XII

WAX AND FLOOR FINISH STRIPPER

| INGREDIENT | GALS. | WEIGHT (lb.) | % BY WEIGHT |
|---|---|---|---|
| Surfactant System Concentrate (Example I) | .014 | .12 | 1.4 |
| Sodium Hydroxide | | .28 | 3.3 |
| Monoethanolamine | .086 | .72 | 8.5 |
| Isopropyl Alcohol | .01 | .065 | 0.8 |
| Dye to suit | | | |
| Water | 0.89 | 7.30 | 86.1 |

EXAMPLE XIII

HIGH FOAM DEGREASING CLEANER

| INGREDIENT | WEIGHT(lb.) | % BY WEIGHT |
|---|---|---|
| Surfactant System Concentrate (Example I) | 0.3 | 3.5 |
| Sodium Metasilicate | 0.22 | 2.6 |
| Sodium Hydroxide | 0.20 | 2.3 |
| Lauryl Dimethyl Amine Oxide | .15 | 1.7 |
| Tetrasodium E.D.T.A. | 0.07 | 0.8 |
| Dye to suit | | |
| Water | 7.68 | 89.1 |

EXAMPLE XIV

GLASS AND SMOOTH SURFACE CLEANER AND POLISH

| INGREDIENT | GALS. | WEIGHT (lb.) | % BY WEIGHT |
|---|---|---|---|
| Surfactant System Concentrate (Example I) | 0.00023 | .002 | .03 |
| Isopropyl Alcohol | 0.184 | 1.20 | 15.0 |
| Ethylene glycol monobutyl ether | 0.032 | .24 | 3.0 |
| Water | 0.784 | 6.53 | 81.9 |

EXAMPLE XV

SOAP FILM REMOVER

| INGREDIENT | GALS. | WEIGHT (lb.) | % BY WEIGHT |
|---|---|---|---|
| Surfactant System Concentrate (Example I) | .036 | 0.3 | 3.3 |

EXAMPLE XV-continued

| SOAP FILM REMOVER | | | |
|---|---|---|---|
| INGREDIENT | GALS. | WEIGHT (lb.) | % BY WEIGHT |
| Sodium Carbonate | | .13 | 1.5 |
| Sodium Metasilicate | | .20 | 2.2 |
| Tetrasodium Pyrophosphate | | .10 | 1.1 |
| Tetrasodium E.D.T.A. | | .42 | 4.7 |
| Isopropyl Alcohol | .033 | .22 | 2.4 |
| Water | .933 | 7.57 | 84.7 |

The foregoing detailed description of several preferred examples has been provided for clearness of understanding only, and no unnecessary limitations in the invention should be understood therefrom. Numerous additions and modifications therein will become readily apparent to persons skilled in the art without departing from the spirit and scope of the invention as set forth in the following claims.

I claim:

1. An ammoniated floor stripper and degreaser constituting a mixture including about 0.3 parts by weight of a surfactant system comprising a. about 25–75% by weight of a non-ionic detergent which is a condensation product of about 4–16 moles of ehtylene oxide with one mole of a compound selected from the group consisting of
   (1) an alkyl phenol having about 7–10 carbon atoms in the alkyl group;
   (2) an alkyl amine having about 12–16 carbon atoms in the alkyl group;
   (3) an aliphatic alcohol having about 12–16 carbon atoms; and
   (4) a hydrophobic base formed by condensing propylene oxide with propylene glycol;

b. about 5–65% by weight of an amine oxide selected from the group consisting of
   (1) alkyl di(lower alkyl) amine oxides in which the alkyl group has about 10–20 carbon atoms and the lower alkyl groups have about 1–7 carbon atoms;
   (2) alkyl di(hydroxy lower alkyl) amine oxides in which the alkyl group has about 10–20 carbon atoms and the lower alkyl groups have about 1–7 carbon atoms;
   (3) alkylamidopropyl di(lower alkyl) amine oxides in which the alkyl group has about 10–20 carbon atoms and the lower alkyl groups have about 1–7 carbon atoms; and
   (4) alkyl morpholine oxides in which the alkyl group has about 10–20 carbon atoms;

c. about 8–50% by weight of a quaternary ammonium halide having the formula

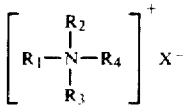

wherein X is a halide and the quaternary ammonium radical is selected from the group consisting of
   (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;
   (2) radicals wherein $R_1$, $R_2$ and $R_3$ are lower alkyl, and $R_4$ is an alkyl or phenyl-substituted alkyl group having about 8–20 carbon atoms;
   (3) radicals wherein $R_1$ is an alkyl or phenyl-substituted alkyl group having about 10–20 carbon atoms, $R_2$ is lower alkyl, $R_3$ is $[-CH_2CH_2O-]_xH$, and $R_4$ is $[-CH_2CH_2O-]_yH$, wherein the sum of x and y is between about 2 and 50;

d. about 0.5 parts by weight of an alkaline inorganic builder;

e. about 0.05 parts by weight of ammonia; and f. about 7.9 parts by weight water.

2. A non-phosphate cleaner constituting a mixture including about 0.3 part by weight of a surfactant system comprising a. about 25–75% by weight of a non-ionic detergent which is a condensation product of about 4–16 moles of ethylene oxide with one mole of a compound selected from the group consisting of
   (1) an alkyl phenol having about 7–10 carbon atoms in the alkyl group;
   (2) an alkyl amine having about 12–16 carbon atoms in the alkyl group;
   (3) an aliphatic alcohol having about 12–16 carbon atoms; and
   (4) a hydrophobic base formed by condensing propylene oxide with propylene glycol;

b. about 5–65% by weight of an amine oxide selected from the group consisting of
   (1) alky di(lower alkyl) amine oxides in which the alkyl group has about 10–20 carbon atoms and the lower alkyl groups have about 1–7 carbon atoms;
   (2) alkyl di(hydroxy lower alkyl) amine oxides in which the alkyl group has about 1–7 carbon atoms;
   (3) alkylamidopropyl di(lower alkyl) amine oxides in which the alkyl group has about 10–20 carbon atoms and the lower alkyl groups have about 1–7 carbon atoms; and
   (4) alkyl morpholine oxides in which the alkyl group has about 10–20 carbon atoms;

c. about 8–50% by weight of a quaternary ammonium halide having the formula

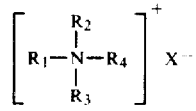

wherein X is a halide and the quaternary ammonium radical is selected from the group consisting of
   (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;

(2) radicals wherein $R_1$, $R_2$ and $R_3$ are lower alkyl, and $R_4$ is an alkyl or phenyl-substituted alkyl group having about 8–20 carbon atoms;

(3) radicals wherein $R_1$ is an alkyl or phenyl-substituted alkyl group having about 10–20 carbon atoms, $R_2$ is lower alkyl, $R_3$ is $[-CH_2CH_2O-]_xH$, and $R_4$ is $[-CH_2CH_2O-]_yH$, wherein the sum of x and y is between about 2 and 50;

d. about 0.15 parts by weight of sodium carbonate;

e. about 0.045 parts by weight of sodium metasilicate;

f. about 0.052 parts by weight of sodium borate;

g. about 0.06 parts by weight of tetrasodium ethylene diamine tetraacetate; and h. about 7.9 parts by weight of water.

3. A wax and floor finish stripper constituting a mixture including:

about 0.12 parts by weight of a surfactant system comprising a. about 25–75% by weight of a non-ionic detergent which is a condensation product of about 4–16 moles of ethylene oxide with one mole of a compound selected from the group consisting of (1) an alkyl phenol having about 7–10 carbon atoms in the alkyl group;

(2) an alkyl amine having about 12–16 carbon atoms in the alkyl group;

(3) an aliphatic alcohol having about 12–16 carbon atoms; and (4) a hydrophobic base formed by condensing propylene oxide with propylene glycol;

b. about 5–65% by weight of an amine oxide selected from the group consisting of (1) alkyl di(lower alkyl) amine oxides in which the alkyl group has about 10–120 carbon atoms and the lower alkly groups have about 1–7 carbon atoms;

(2) alkyl di(hydroxy lower alkyl) amine oxides in which the alkyl group has about 10–20 carbon atoms and the lower alkyl groups have about 1–7 carbon atoms;

(3) alkylamidopropyl di(lower alkyl) amine oxides in which the alkyl group has about 10–20 carbon atoms and the lower alkyl groups have about 1–7 carbon atoms; and (4) alkyl morpholine oxides in which the alkyl group has about 10–20 carbon atoms;

c. about 8–50% by weight of a quaternary ammonium halide having the formula

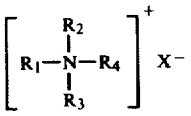

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;

(2) radicals wherein $R_1$, $R_2$ and $R_3$ are lower alkyl, and $R_4$ is an alkyl or phenyl-substituted alkyl group having about 8–20 carbon atoms;

(3) radicals wherein $R_1$ is an alkyl or phenyl-substituted alkyl group having about 10–20 carbon atoms, $R_2$ is lower alkyl, $R_3$ is $[-CH_2CH_2O-]_xH$, and $R_4$ is $[-CH_2CH_2O-]_yH$, wherein the sum of x and y is between about 2 and 50;

d. about 0.3 parts by weight of sodium hydroxide;

e. about 0.7 parts by weight of monoethanolamine;

f. about 0.07 parts by weight of isopropyl alcohol; and g. about 7.3 parts by weight water.

4. A high foam degreasing cleaner constituting a mixture including about 0.45 parts by weight of a surfactant system comprising a. about 25–75% by weight of a non-ionic detergent which is a condensation product of about 4–16 moles of ethylene oxide with one mole of a compound selected from the group consisting of (1) an alkyl phenol having about 7–10 carbon atoms in the alkyl group;

(2) an alkyl amine having about 12–16 carbon atoms in the alkyl group;

(3) an aliphatic alcohol having about 12–16 carbon atoms; and (4) a hydrophobic base formed by condensing propylene oxide with propylene glycol;

b. about 5–65% by weight of an amine oxide selected from the group consisting of (1) alkyl di(lower alkyl) amine oxides in which the alkyl group has about 10–20 carbon atoms and the lower alkyl groups have about 1–7 carbon atoms;

(2) alkyl di(hydroxy lower alkyl) amine oxides in which the alkyl group has about 10–20 carbon atoms and the lower alkyl groups have about 1–7 carbon atoms;

(3) alkylamidopropyl di(lower alkyl) amine oxides in which the alkyl group has about 10–20 carbon atoms and the lower alkyl groups have about 1–7 carbon atoms; and (4) alkyl morpholine oxides in which the alkyl group has about 10–20 carbon atoms;

said amine oxides being present in a total concentration of about 38.3% to about 43.3% by weight of said system;

c. about 8–50% by weight of a quaternary ammonium halide having the formula

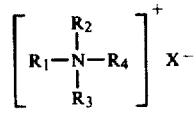

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;

(2) radicals wherein $R_1$, $R_2$ and $R_3$ are lower alkyl, and $R_4$ is an alkyl or phenyl-substituted alkyl group having about 8-20 carbon atoms;

(3) radicals wherein $R_1$ is an alkyl or phenyl-substituted alkyl group having about 10-20 carbon atoms, $R_2$ is lower alkyl, $R_3$ is $[-CH_2CH_2O-]_xH$, and $R_4$ is $[-CH_2CH_2O-]_yH$, wherein the sum of x and y is between about 2 and 50;

d. about 0.2 parts by weight of sodium metasilicate;

e. about 0.2 parts by weight of sodium hydroxide;

f. about 0.07 parts by weight of tetrasodium ethylene diamine tetraacetate; and g. the remainder water.

5. A cleaner for glass and other smooth surfaces constituting a mixture including about 0.002 parts by weight of the surfactant system comprising a. about 25-75% by weight of a non-ionic detergent which is a condensation product of about 4-16 moles of ethylene oxide with one mole of a compound selected from the group consisting of (1) an alkyl phenol having about 7-10 carbon atoms in the alkyl group;

(2) an alkyl amine having about 12-16 carbon atoms in the alkyl group;

(3) an aliphatic alcohol having about 12-16 carbon atoms; and (4) a hydrophobic base formed by condensing propylene oxide with propylene glycol;

b. about 5-65% by weight of an amine oxide selected from the group consisting of (1) alkyl di(lower alkyl) amine oxides in which the alkyl group has about 10-20 carbon atoms and the lower alkyl groups have about 1-7 carbon atoms;

(2) alkyl di(hydroxy lower alkyl) amine oxides in which the alkyl group has about 10-20 carbon atoms and the lower alkyl groups have about 1-7 carbon atoms;

(3) alkylamidopropyl di(lower alkyl) amine oxides in which the alkyl group has about 10-20 carbon atoms and the lower alkyl groups have about 1-7 carbon atoms; and (4) alkyl morpholine oxides in which the alkyl group has about 10-20 carbon atoms;

c. about 8-50% by weight of a quaternary ammonium halide having the formula

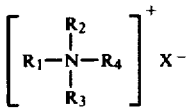

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1-18 carbon atoms or an alkyl group having about 8-20 carbon atoms, and $R_4$ is a phenyl group or a phenyl group substituted with an alkyl group having about 1-18 carbon atoms or an alkyl group having about 8-20, and preferably 12-18 carbon atoms;

(2) radicals wherein $R_1$, $R_2$ and $R_3$ are lower alkyl, and $R_4$ is an alkyl or phenyl-substituted alkyl group having about 8-20 carbon atoms;

(3) radicals wherein $R_1$ is an alkyl or phenyl-substituted alkyl group having about 10-20 carbon atoms, $R_2$ is lower alkyl, $R_3$ is $[-CH_2CH_2O-]_xH$, and $R_4$ is $[-CH_2CH_2O-]_yH$, wherein the sum of x and y is between 2 and 50;

d. about 1.2 parts by weight of isopropyl alcohol;

e. about 0.24 parts by weight ethylene glycol monoethyl ether; and f. the remainder water.

6. A soap film remover constituting a mixture including about 0.3 parts by weight of the surfactant system comprising a. about 25-75% by weight of a non-ionic detergent which is a condensation product of about 4-17 moles of ethylene oxide with one mole of a compound selected from the group consisting of (1) an alkyl phenol having about 7-10 carbon atoms in the alkyl group;

(2) an alkyl amine having about 12-16 carbon atoms in the alkyl group;

(3) an aliphatic alcohol having about 12-16 carbon atoms; and (4) a hydrophobic base formed by condensing propylene oxide with propylene glycol;

b. about 5-65% by weight of an amine oxide selected from the group consisting of (1) alkyl di(lower alkyl) amine oxides in which the alkyl group has about 10-20 carbon atoms and the lower alkyl groups have about 1-7 carbon atoms;

(2) alkyl di(hydroxy lower alkyl) amine oxides in which the alkyl group has about 10-20 carbon atoms and the lower alkyl groups have about 1-7 carbon atoms;

(3) alkylamidopropyl di(lower alkyl) amine oxides in which the alkyl group has about 10-20 carbon atoms and the lower alkyl groups have about 1-7 carbon atoms; and (4) alkyl morpholine oxides in which the alkyl group has about 10-20 carbon atoms;

c. about 8-50% by weight of a quaternary ammonium halide having the formula

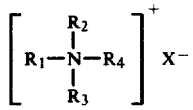

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1-18 carbon atoms or an alkyl group having about 8-20 carbon atoms, and $R_4$ is a phenyl group or a phenyl group substituted with an alkyl group having about 1-18 carbon atoms or an alkyl group having about 8-20, and preferably 12-18 carbon atoms;

(2) radicals wherein $R_1$, $R_2$ and $R_3$ are lower alkyl, and $R_4$ is an alkyl or phenyl-substituted alkyl group having about 8-20 carbon atoms;

(3) radicals wherein $R_1$ is an alkyl or phenyl-substituted alkyl group having about 10-20 carbon atoms, $R_2$ is lower alkyl, $R_3$ is $[-CH_2CH_2O-]_xH$, and $R_4$ is $[-CH_2CH_2O-]_yH$, wherein the sum of x and y is between about 2 and 50;

d. about 0.4 parts by weight of an alkaline inorganic builder;

e. about 0.4 parts by weight of tetrasodium ethylene diamine tetraacetate;

f. about 0.2 parts by weight of isopropyl alcohol; and g. about 7.6 parts by weight water.

7. A surfactant system comprising a. about 25–75% by weight of a non-ionic detergent which is a mixture of about 25% by weight of condensation product of about 4–5 moles of ethylene oxide with one mole of nonyl phenol and about 75% by weight of a condensation product of 8–12 moles of ethylene oxide with one mole of nonyl phenol;

b. about 5–65% by weight of an amine oxide selected from the group consisting of (1) alkyl di(lower alkyl) amine oxides in which alkyl group has about 10–20 carbon atoms and the lower alkyl groups have about 1–7 carbon atoms;

(2) alkyl di(hydroxy lower alkyl) amine oxides in which the alkyl group has about 10–20 carbon atoms and the lower alkyl groups have about 1–7 carbon atoms;

(3) alkylamidopropyl di(lower alkyl) amine oxides in which the alkyl group has about 10–20 carbon atoms and the lower alkyl groups have about 1–7 carbon atoms; and (4) alkyl morpholine oxides in which the alkyl group has about 10–20 carbon atoms;

c. about 8–50% by weight of a quaternary ammonium halide having the formula

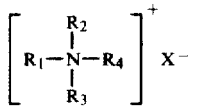

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;

(2) radicals wherein $R_1$, $R_2$ and $R_3$ are lower alkyl, and $R_4$ is an alkyl or phenyl-substituted alkyl group having about 8–20 carbon atoms;

(3) radicals wherein $R_1$ is an alkyl or phenyl-substituted alkyl group having about 10–20 carbon atoms, $R_2$ is lower alkyl, $R_3$ is $[—CH_2CH_2O—]_xH$, and $R_4$ is $[—CH_2CH_2O—]_yH$, wherein the sum of x and y is between about 2 and 50; and d. the remainder water.

8. A surfactant system comprising:

a. about 25–75% by weight of a non-ionic detergent comprising about 25% by weight of a condensation product of 4–5 moles of ethylene oxide with 1 mole of nonyl phenol, and about 75% by weight of a condensation product of 8–12 moles of ethylene oxide with 1 mole of nonyl phenol;

b. about 5–65% by weight of an amine oxide selected from the group consisting of (1) alkyl di(lower alkyl) amine oxides in which the alkyl group has about 10–20 carbon atoms and the lower alkyl groups have about 1–7 carbon atoms;

(2) alkyl di(hydroxy lower alkly) amine oxides in which the alkyl group has about 10–20 carbon atoms and the lower alkyl groups have about 1–7 carbon atoms;

(3) alkylamidopropyl di(lower alkyl) amine oxides in which the alkyl group has about 10–20 carbon atoms and the lower alkyl groups have about 1–7 carbon atoms; and (4) alkyl morpholine oxides in which the alkyl group has about 10–20 carbon atoms;

c. about 8–50% by weight of a quaternary ammonium halide having the formula

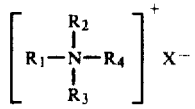

wherein X is a halide and the quaternary ammonium radical is selected from the group consisting of (1) radicals wherein $R_1$ and $R_2$ are lower alkyl, $R_3$ is a phenyl group or phenyl group substituted with an alkyl group having about 1–18 carbon atoms or an alkyl group having about 8–20 carbon atoms, and $R_4$ is a phenyl group or a phenyl group substituted with an alkyl group having about 1–18 carbon atoms or an alkyl group having about 8–20, and preferably 12–18 carbon atoms;

(2) radicals wherein $R_1$, $R_2$ and $R_3$ are lower alkyl, and $R_4$ is an alkyl or phenyl-substituted alkyl group having about 8–20 carbon atoms;

(3) radicals wherein $R_1$ is an alkyl or phenyl-substituted alkyl group having about 10–20 carbon atoms, $R_2$ is lower alkyl, $R_3$ is $[—CH_2CH_2O—]_xH$, and $R_4$ is $[—CH_2CH_2O—]_yH$, wherein the sum of x and y is between about 2 and 50; and d. the remainder water.

9. The surfactant system of claim 8, and further comprising about 1–6% by weight of isopropanol.

* * * * *